United States Patent [19]

Touchette

[11] 4,036,504

[45] July 19, 1977

[54] RING PUZZLE

[76] Inventor: Claude Touchette, 12 Lockport, Toronto, Ontario, Canada

[21] Appl. No.: 689,176

[22] Filed: May 24, 1976

[51] Int. Cl.[2] ..... A63F 9/08
[52] U.S. Cl. ..... 273/158
[58] Field of Search ..... 273/158; 17/69

[56] References Cited

U.S. PATENT DOCUMENTS

| | | | |
|---|---|---|---|
| 2,998,253 | 8/1961 | Kranzusch | 273/158 |
| 3,271,814 | 9/1966 | Gorton | 17/69 |

FOREIGN PATENT DOCUMENTS

| | | | |
|---|---|---|---|
| 437,330 | 2/1912 | France | 273/158 |
| 118,993 | 2/1927 | Switzerland | 273/158 |

*Primary Examiner*—Anton O. Oechsle
*Attorney, Agent, or Firm*—Allen D. Brufsky

[57] ABSTRACT

A puzzle of the type having a plurality of rings and posts with an elongated, closed loop threaded therethrough, the object of the puzzle being to remove the loop by an elaborate and lengthy sequence of manipulation of the rings and the loop. In order to aid in the dexterity of the manipulation of the rings and loop, a substantially U-shaped handle is connected to one end of the loop for gripping by the thumb and fingers in spaced relation.

2 Claims, 2 Drawing Figures

RING PUZZLE

BACKGROUND OF THE INVENTION

This invention relates generally to puzzles.

Puzzles of the type with which the present invention is concerned are old, being shown in a number of prior patents, one of the most explicit being U.S. Pat. No. 3,698,719. Essentially, this type of puzzle comprises a number of individual rings, each of which is articulately loosely connected to one end of a short post, all of the posts in turn being loosely anchored at their other ends in a common base member. An elongated closed loop straddles the posts and passes through the rings in a uniform manner. To solve the puzzle, i.e., to remove the loop, requires a very lengthy series, depending on the number of rings involved, of precise steps. Likewise, to replace the loop afterwards requires the entire procedure to be repeated, but in reverse.

Until the puzzle is thoroughly mastered, its solution is tedious, time consuming and frustrating because unless the proper steps are rigidly followed, the loop cannot be removed. Errors are as difficult to correct as it is to restore the loop to its starting position so one can begin over again. Both procedures require the loop to be held for protracted periods of time by the thumb and fingers of one hand while the rings are manipulated up or down with the thumb and fingers of the other hand, the loop simultaneously being slid to the left or right. The proper manipulation of the various elements of the puzzle requires exact coordination of the hands in removing the loop.

SUMMARY OF THE INVENTION

In order to aid in mastering the puzzle, the loop is provided with a U-shaped handle, one portion of the handle being adapted for gripping by the thumb and the other portion including finger grips for the fingers. By grasping the handle on the loop in one hand, which keeps the thumb and fingers in spaced relation on the loop it can be more dexteriously moved in conjunction with the manipulation of the rings by the other hand to solve the puzzle. A similar handle may be provided on the base member so the puzzle may be turned and/or held at its opposite end while the rings are manipulated with the other hand.

BRIEF DESCRIPTION OF THE DRAWING

Further objects and advantages of the invention will become more apparent from the following description and claims, and from the accompanying drawing wherein:

DETAILED DESCRIPTION OF THE PREFERRED EMBODIMENT

Figure 1:
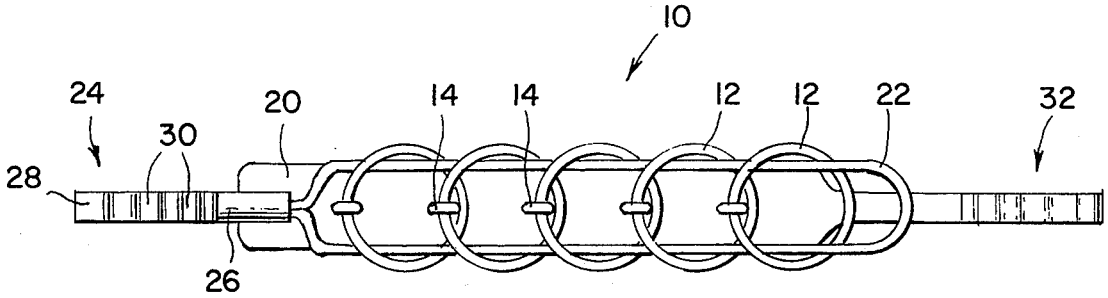
FIG. 1 is a top plan view of the ring puzzle of the present invention.
Figure 2:
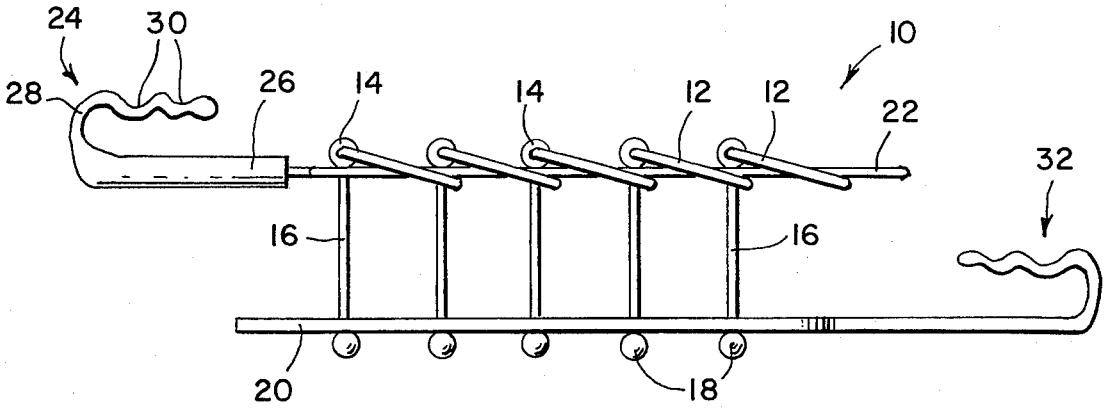
FIG. 2 is a side view in elevation of the ring puzzle shown in FIG. 1.

Referring now to the drawing in detail, wherein like numerals indicate like elements throughout the several views, the ring puzzle 10 of the present invention includes a series of closed rings 12, each of which is held captive in an eyelet 14 on the top of a wire post 16 secured by enlarged heads or spherical balls 18 to an elongated base member 20; the eyelets 14 being arranged in a straight row. An elongated closed wire loop 22 entraps all the eyelets 14 by extending through the rings 12 in straddling relationship to posts 16.

By skillful manipulation of the rings 12 and loop 22 in various combinations as disclosed in U.S. Pat. No. 3,698,719, the loop 22 can be extracted, thus solving the puzzle.

In the present invention, the loop 22 includes a substantially U-shaped handle 24, the bottom portion 26 of handle 24 being adapted for gripping by the thumb and the other portion 28 including finger grips 30 for the fingers of one hand, while the other hand manipulates the rings 12 to solve the puzzle. By grasping the handle 24, which keeps the thumb and fingers in spaced relation on loop 22, the loop 22 can be more dexteriously moved in conjunction with the manipulation of the rings 12 by the other hand while solving the puzzle. A similar handle 32 may be provided on base member 20 so the puzzle 10 may be turned and/or held in the other hand, while the rings 12 are manipulated with the first hand in the tedious solution.

I claim:

1. In a puzzle having a plurality of postlike members and a plurality of ring-like members, said ringlike members being articulately attached adjacent the corresponding ends of respective ones of said post-like members, and an elongated, closed loop-like member in interlocking engagement with respective pairs of said post-like and ring-like members so that said loop-like member can normally be disengaged from said post-like and ring-like members only be a series of prescribed manipulations of all of said members, the improvement comprising a substantially U-shaped handle on one end of said loop-like member having separated portions for gripping by the thumb and fingers of one hand while the other hand manipulates said rings, the other ends of said post-like members being connected to an elongated base member, and a substantially U-shaped handle connected to one end of said base member, said U-shaped handle on said base member being on the other end of said puzzle than said U-shaped handle on said loop-like member.

2. In a puzzle in accordance with claim 1 wherein one of the portions of said U-shaped handles includes at least one finger grip.

* * * * *